United States Patent [19]

Kondo et al.

[11] 3,985,109

[45] Oct. 12, 1976

[54] BREAKERLESS IGNITION SYSTEM FOR AN INTERNAL COMBUSTION ENGINE

[75] Inventors: Tetsuya Kondo, Susono; Takeshi Watanabe, Fuji, both of Japan

[73] Assignee: Kokusan Denki Co., Ltd., Numazu, Japan

[22] Filed: Jan. 27, 1975

[21] Appl. No.: 544,173

[30] Foreign Application Priority Data

Jan. 30, 1974 Japan ..... 49-12349

[52] U.S. Cl. ..... 123/8.09; 123/118; 123/198 F; 123/97 B; 123/148 E

[51] Int. Cl.[2] ..... F02P 5/04; F02P 1/00

[58] Field of Search ..... 123/8.09, 118, 198 F, 123/148 E, 97 B, 198 DC

[56] References Cited

UNITED STATES PATENTS

| | | | |
|---|---|---|---|
| 3,584,608 | 6/1971 | Shibagaki | 123/8.09 |
| 3,589,344 | 6/1971 | Steinke | 123/8.09 |
| 3,863,616 | 2/1975 | Wood | 123/118 |
| 3,868,928 | 3/1975 | Kishimoto | 123/8.09 |
| 3,898,963 | 8/1975 | Iwata | 123/32 EA |

*Primary Examiner*—Charles J. Myhre
*Assistant Examiner*—R. B. Cox
*Attorney, Agent, or Firm*—Woodling, Krost, Granger & Rust

[57] ABSTRACT

A breakerless ignition system for an internal combustion engine comprising an ignition power supply, a capacitance discharge type ignition circuit including a capacitance, an ignition coil and a first semiconductor switching means to discharge the capacitance through the ignition coil on the primary side thereof, and an ignition signal source to trigger the first semiconductor switching means to be turned on, the ignition system further comprising an ignition inhibiting means including a second semiconductor switching means arranged so that it periodcally prevents the ignition power from being applied to the ignition circuit when the speed of the engine becomes less than a predetermined value and also when the intake vacuum pressure of the engine exceeds a predetermined value.

7 Claims, 7 Drawing Figures

FIG.1
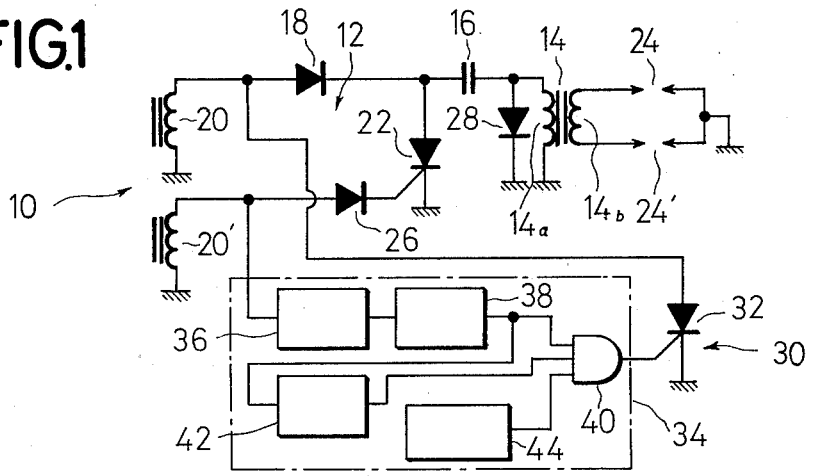
FIG.2a
FIG.2b
FIG.2c
FIG.2d
FIG.2e
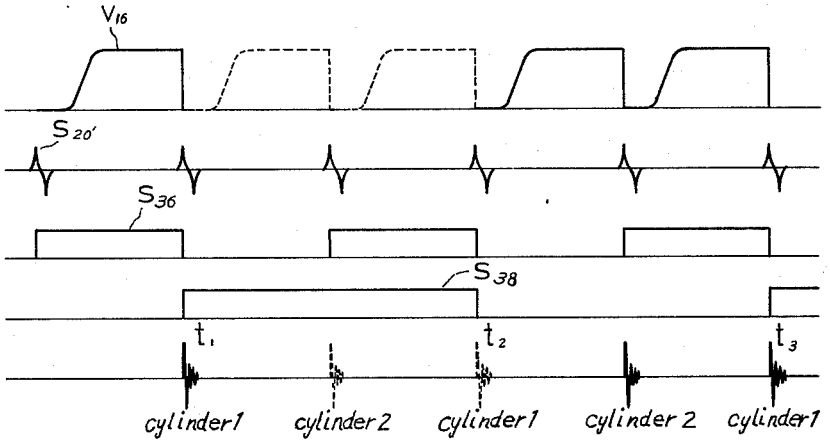
FIG.3
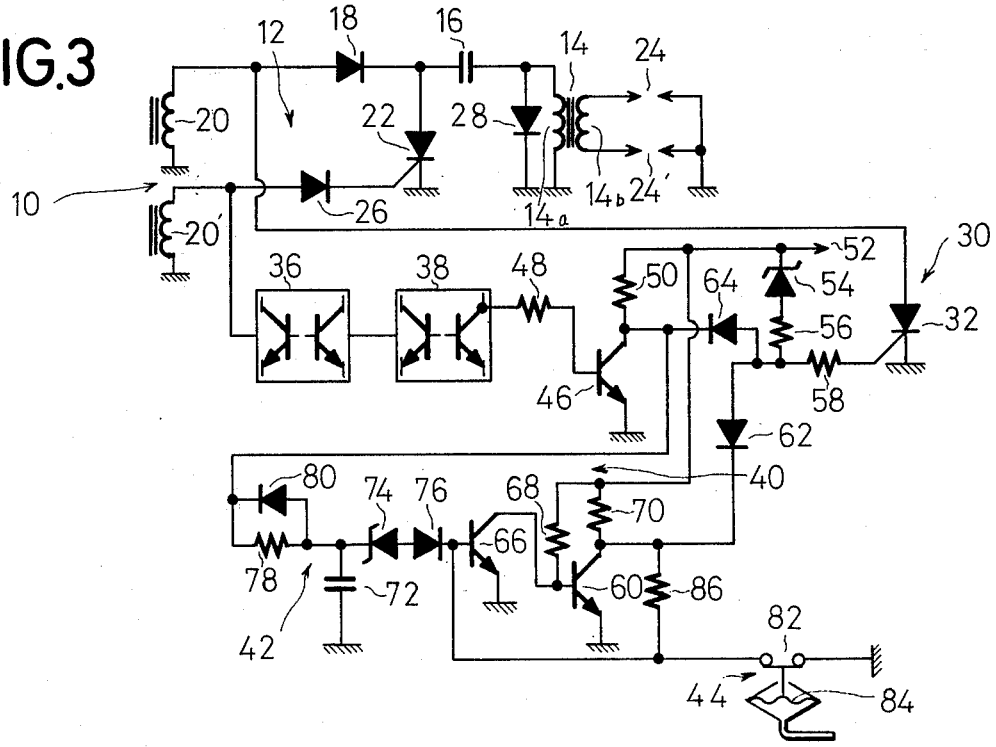

BREAKERLESS IGNITION SYSTEM FOR AN INTERNAL COMBUSTION ENGINE

BACKGROUND OF THE DISCLOSURE

It is well known that an internal combustion engine tends to be fired in an improper manner when it is operated at a relatively low load such as when it is decelerated from high speed operation, when an engine brake is applied thereto or when it is idling. Under such condition, the engine tends to cause uncomfortable noise. Especially, a rotary engine has such tendency to a considerable degree and, therefore, irregularly repeats a fire and a misfire with the result that variation in torque and uncomfortable noise occur.

Of late, an ignition system has been proposed that is adapted to control an ignition circuit or circuits so that the ignition can be repetitively effective and ineffective in a forced manner in time with the tendency of fire and misfire. In the prior art, an ignition system of such a type comprises two sets of ignition circuits each including an ignition coil and a contact breaker connected to the primary side of the ignition coil, with the contact breaker of one of the ignition circuits having the interruption frequency of one half that of the other contact breaker. In the normal operation, the ignition having the higher interruption frequency is operated so that the ignition can be normally effected, but when the engine tends to be fired in an improper manner as previously described, the engine is switched to the other ignition circuit having the lower interruption frequency so that the engine is fired at a frequency one half that of the normal operation. However, such ignition system necessitates a reduction mechanism which is required to reduce the frequency of operation of the contact breaker of the one ignition circuit, which causes the construction of the apparatus to be complicated.

SUMMARY OF THE INVENTION

Accordingly, it is a principal object of the present invention to provide an ignition system for an internal combustion engine which is adapted to allow the ignition to be effected and inhibited in an alternate manner without resorting to any reduction mechanism.

One of the most important features of the present invention is that a capacitance discharge type ignition system provides an ignition inhibiting means which comprises a second semiconductor switching means connected in parallel to an ignition power supply. The ignition inhibiting means further comprises a flip-flop means operated by an igniting signal which permits a first semiconductor switching means of an ignition circuit to be conductive so that a capacitance is discharged through an ignition coil, a speed detector to produce an output signal when the speed of an engine becomes less than a predetermined value, a vacuum pressure detector to produce an output signal when the intake vacuum pressure of the engine exceeds a predetermined value, and means to cause conduction of the second semiconductor switching means of the ignition inhibiting means when all of the output signals from the flip-flop means and the speed and vacuum pressure detectors are received.

Another important feature of the present invention is that the ignition inhibiting means further comprises means to prevent the conduction of the second semiconductor switching means of the ignition inhibiting means when a power source voltage for the control circuit of the ignition inhibiting means is below a predetermined level.

BRIEF DESCRIPTION OF THE DRAWING

Other objects and features of the present invention will be apparent from the detailed description of the preferred embodiment taken with reference to the accompanying drawing, in which;

FIG. 1 is a schematic diagram of an embodiment of an ignition system in accordance with the present invention;

FIG. 2*a* to 2*e* show the waveforms appearing at the components of the embodiment of FIG. 1; and FIG. 3 is a circuit diagram of an apparatus embodying the present invention.

DETAILED DESCRIPTION OF THE PREFERRED EMBODIMENTS

FIG. 1 schematically shows a capacitance discharge type ignition system for a two cylinder internal combustion engine, indicated generally at numeral 10 which comprises an ignition circuit 12 including an ignition coil 14 having a primary winding 14*a* and a secondary winding 14*b*. A capacitance 16 has one end connected to one end of the primary winding 14*a* the other end of which is grounded, and has the other end connected through a diode 18 to one end of an ignition power supply such as a generating coil 20 of a magnetic generator the other end of which is grounded. A first semiconductor switching means such as a thyristor 22 has the anode connected to the point of junction between the capacitance 16 and the cathode of the diode 18 and has the cathode grounded. The capacitance 16 is charged by a current flowing from the generating coil 20 through the diode 18 and the capacitance 16. When the thyristor 22 is turned on the capacitance 16 is discharged through the thyristor 22 and the primary winding 14*a* to induce a high voltage across the secondary winding 14*b* of the ignition coil. Two spark plugs 24 and 24' which are disposed within two cylinders of the engine (not shown), respectively, are provided in series connection with the respective ends of the secondary winding 14*b*. The high voltage across the secondary winding 14*b* causes the spark plugs to spark so that one of the cylinders in which the point of explosion is being reached is fired. A signal coil 20' may be provided as a signal source in the magnetic generator and has one end connected through a diode 26 to the gate of the thyristor 22 and has the other end grounded. Since the magnetic generator rotates in time with the engine, the generating coil 20 produces ignition power to charge the capacitance before one of the cylinders reaches the ignition timing point and then the signal coil 20' produces a signal to trigger the thyristor 22 when the cylinder reaches the ignition timing point. The operation of the ignition system 10 is conventional and therefore, it need not be described furthermore hereinafter. It will be understood by those skilled in the art that the signal source 20' may be disposed outside the magnetic generator and arranged to operate in time with rotation of the engine. It will be also understood that when one of the cylinders is under the explosion condition, the other cylinder is not under such condition and therefore, cannot be fired while the corresponding spark plug sparks. A damping diode 28 may be provided in parallel connection with the primary coil 14*a* of the ignition coil 14 as in a conventional manner.

The ignition system of the present invention is provided with ignition inhibiting or misfiring means 30 which comprises a second semiconductor switching means such as an inhibiting thyristor 32 having the anode connected to the point of junction between the generating coil 20 and the anode of the diode 18 and having the cathode grounded. Thus, it will be understood that the thyristor 32, when in the conductive state, causes the current from the gerating coil 20 to flow therethrough to ground so that the current is prevented from flowing through the capacitance 16.

The ignition inhibiting means 30 further comprises a control circuit 34 to control the thyristor 32. The control circuit 34 comprises a first flip-flop circuit 36 which receives the output signal from the signal coil 20' to produce a signal therefrom at one-half frequency and a second flip-flop circuit 38 which operates by receiving a signal from the first flip-flop circuit 36 to produce a signal therefrom at one-fourth frequency. An AND gate 40 is provided in the control circuit and has the output connected to the gate of the thyristor 32. The second flip-flop circuit 38 has the output connected to one of the inputs of the AND gate 40.

A speed detector 42 is provided which electrically detects the revolution number of the engine by receiving the output signal from the second flip-flop circuit 38, and produces a signal therefrom when the revolution number of the engine is below a predetermined value. The revolution number detector 42 has the output connected to another input of the AND gate 40.

A vacuum pressure detector 44 is also provided which electrically detects an intake manifold vacuum pressure of the engine, and produces a signal therefrom when the vacuum pressure exceeds a predetermined value.

In operation, after the generating coil 20 of the magneto generator charges the capacitance 16, the signal coil 20' produces a signal at an ignition time of one of the cylinders, causing the thyristor 22 to conduct, which in turn causes the capacitance 16 to be discharged through the thyristor 22 and the primary winding 14*a* of the ignition coil 14 to thereby establish a high voltage across the secondary winding 14*b* of the ignition coil 14. FIG. 2*a* shows a waveform of the voltage $V_{16}$ across the capacitance 16 and when the voltage drops by discharging the capacitance 16, the high voltage as shown in FIG. 2*e* is established across the ignition coil. Thus, one of the cylinders is ignited by sparking of the corresponding spark plug 24 or 24'. When an ignition signal as shown in FIG. 2*b* is produced from the signal coil 20', the first flip-flop circuit 36 is triggered so that a signal $S_{36}$ of high level appears at the output as shown in FIG. 2*c*, and when the next signal as shown in FIG. 2*b* is produced from the signal coil 20', flip-flop 36 is triggered so that the signal at the output of the first flip-flop circuit 36 drops. When the signal shown in FIG. 2*c* drops, the second flip-flop circuit 38 is triggered so that a signal $S_{38}$ of high level appears at the output thereof as shown in FIG. 2*d* and when the next signal at the output of the first flip-flop circuit 36 drops, the second flip-flop circuit is triggered so that the signal at the output thereof drops. Thus, it will be noted from FIG. 2 that the signal at the output of the second flip-flop circuit 38 has a period twice as long as that of the first flip-flop circuit 36. The signal $S_{38}$ is applied to one of the inputs of the AND gate 40.

When the speed of the engine is less than a predetermined value and also when the intake vacuum pressure of the engine is greater than a predetermined value, the speed detector 42 and the vacuum pressure detector 44 produce respective signals at the outputs and the signals are applied to the other inputs of the AND gate 40. Under such condition, when the signal $S_{38}$ is applied from the second flip-flop circuit to the corresponding input of the AND gate 40 at time *t*1, the AND gate is turned on. Accordingly, the thyristor 32 of the ignition inhibiting means 30 is triggered to be turned on, with the result that the generating coil 20 is short-circuited from the ignition circuit 12. This condition continues until the signal $S_{38}$ from the output of the second flip-flop circuit 38 drops. Thus, as indicated by dotted lines of FIG. 2*a*, charging of the capacitance 16 is prevented for the period of two cycles and as a result two successive high voltages are prevented from being established across the secondary winding of the ignition coil 14 as indicated by dotted lines of FIG. 2*e*. Accordingly, ignition is prevented once at each of the spark plugs 24 and 24'. It will be noted that since the second flip-flop circuit 38 has no output signal during the period from time *t*2 to time *t*3, the thyristor 32 is in the nonconductive state and as a result the normal operation of the ignition circuit 12 continues as shown in FIG. 2. Thus, it will be understood that when the detectors 42 and 44 produce signals from the outputs, the fire and misfire of the cylinders are alternately repeated in a forced manner. thus, when a misfire occurs at a random during the operation at low load of the engine such as when the engine is decelerated from a high speed operation or when an engine brake is effected, the ignition system can ignite or fail to ignite the cylinders periodically in time with the tendency of fire and misfire of the engine, with the result that variation in torque and uncomfortable sound are prevented from occurring.

In the foregoing embodiment, since a single ignition circuit 12 is adapted to energize two spark plugs 24 and 24', two flip-flop circuits 36 and 38 may be used so that two spark plugs are successively inhibited to spark, but it will be understood that in the event that one ignition circuit is adapted to energize a single spark plug, then a single flip-flop circuit may be used for the one ignition circuit.

Referring now to FIG. 3, there is shown a typical example of the ignition system 10 of FIG. 1 and the same numerals designate the same components. The AND gate 40 may comprise a third semiconductor switching means such as an NPN type transistor 46 which has the emitter grounded, has the base connected through a resistance 48 to the output of the second flip-flop circuit 38 and has the collector connected through a resistance 50 to a DC power supply 52. The power supply is also connected through a reversed Zener diode 54 and resistances 56 and 58 to the gate of the inhibiting thyristor 32. The AND gate 40 also comprises a second NPN type transistor 60 which has the collector connected through a diode 62 to the point of junction between the resistances 56 and 58 and has the emitter connected to the ground. The point of junction between the resistances 56 and 58 is also connected through a forwarded diode 64 to the collector of the first transistor 46. Thus, if the first and second transistors 46 and 60 are in the non-conductive state, the DC power supply 52 causes a current to flow through the Zener diode 54 and the resistances 56 and 58 to the gate of the inhibiting thyristor 32 for turning it on. The AND gate also comprises a third NPN type transistor 66 which has the collector connected through a resistance 68 to the DC power supply 52 and has the emitter connected to the ground. The point of junction between the DC power supply 52 and the resistance 68 is connected through a resistance 70 to the collector of the second transistor 60 and the point of junction between the resistance 68 and the collector of the third transistor 66 is connected to the base of the second transistor 60.

The speed detector 42 may comprise a capacitance 72 having one of the ends connected to the ground and the other end connected through a reversed Zener diode 74 and a forwarded diode 76 to the base of the third transistor 66. The collector of the first transistor 46 is also connected through a parallel connection of a resistance 78 and a reversed diode 80 to the other end of the capacitance 72.

The vacuum pressure detector 44 may comprise a switching means 82 adapted to be operated by a diaphragm means 84 which is operatively associated with an intake manifold of the engine. The switching means 82 is opened in response to movement of the diaphragm means 84 when the intake vacuum pressure is greater than a predetermined value. This switching means has one of the ends connected to the ground and the other end connected to the base of the third transistor 66. A resistance 86 may be connected between the point of junction between the diode 62 and the collector of the transistor 60 and the point of junction between the switching means 82 and the base of the transistor 66.

Referring now to the operation of the apparatus of FIG. 3, the first transistor 46 of the AND gate 40 is alternately conductive and non-conductive in accordance with the cycle of the output signals from the second flip-flop circuit 38. The capacitance 72 of the speed detector 42 is charged from the DC power supply 52 through the resistances 50 and 78 while the transistor 46 is non-conductive and the capacitance 72 is discharged through the transistor 46 while it is conductive. It will be noted that the time constant of charging the capacitance 72 is based on the value of the resistances 50 and 78. As the speed of the engine decreases, the voltage across the capacitance 72 increases. Thus, when the voltage across the capacitance 72 reaches the Zener voltage of the Zener diode 74, then the transistor 66 has a voltage applied across the base and the emitter thereof. At this time, if the intake vacuum pressure is less than the predetermined value, the switching means 82 of the detector 44 remains closed and therefore, the base of the third transistor 66 is grounded through the closed switching means 82, with the result that the transistor 66 cannot be conductive. When the third transistor 66 is in the non-conductive state in this manner, the transistor 60 is biased by the DC power supply 52 and is therefore conductive. Thus, a current flows from the DC power supply 52 through the Zener diode 54, the resistance 56, the diode 62 and through the transistor 60 so that it cannot flow through the gate and cathode of the inhibiting thyristor 32. In this manner, the thyristor 32 cannot be conductive with the result that the ignition circuit is operated in a normal manner.

If the speed of the engine is less than the predetermined value and also if the intake vacuum pressure of the engine is greater than the predetermined value, the base of the third transistor 66 has the voltage from caparitance 72 applied thereto because the switching means 82 of the detector 44 is not open and as a result the transistor 66 is turned on while the second transistor 60 is turned off because the biasing power is held from being applied across the base and emitter of the transistor 60. At that time, since the collector of the transistor 60 has a high potential, a current flows through the resistance 86 and through the base and emitter of the transistor 66, with the result that the transistor 66 is held in the conductive state while the transistor 60 is held in the non-conductive state. While the transistor 60 is non-conductive in this manner, when the transistor 46 is interrupted by the second flip-flop circuit 38 producing no signal, the inhibiting thyristor 32 has a current flowing from the DC power supply 52 through the Zener diode 54, through the resistances 56 and 58 and through the gate and cathode of the thyristor 32 for triggering it. On the other hand, when the transistor 46 is made conductive by the signal from the second flip-flop circuit 38, no current flows through the gate and cathode of the inhibiting thyristor 32 so that it is turned off. Thus, it will be understood that while the second transistor 60 is non-conductive, the thyristor 32 is alternately conductive and non-conductive and as previously described in connection with FIG. 2, the fire and misfire are alternately repeated. When the switching means 82 of the detector 84 is closed by the intake vacuum pressure less than the predetermined value, the transistor 66 is rendered non-conductive as previously described, and as a result the transistor 60 becomes conductive to thereby reset the control circuit 34 for the thyristor 32. As understood from the foregoing, when the engine is decelerated from a high speed operation or when the engine brake is applied, the ignition inhibiting means is periodically operated so that occurrence of variation in torque and uncomfortable noise is prevented.

It should be noted that the Zener diode 54 serves to prevent variation in the voltage of the DC power supply applied to the gate of the thyristor 32. If the Zener diode is not provided, the flip-flop circuits 36 and 38 and the transistors 60 and 66 are operated in an erroneous manner or are impossible to be operated due to drop of the voltage of the DC power supply 52. Under such condition, the thyristor 32 is operated in an improper manner so that it is unnecessarily conductive to inhibit firing of the cylinders of the engine. Since the Zener voltage of the Zener diode 54 is set higher than a voltage under which the flip-flop circuits 36 and 38 and the transistors 60 and 66 are operated in an erroneous manner, even if they are operated in an erroneous manner, the thyristor 32 has no gate signal applied thereto and therefore, it is prevented from unnecessarily inhibiting firing of the cylinders. It will be understood that alternatively the resistances 58 may have a relatively large value of resistance without any Zener diode.

It will be also understood that the first and second thyristors 22 and 32 may be replaced by controlled semiconductor switching means such as transistors.

Although some preferred embodiment of the present invention has been illustrated and described with reference to the accompanying drawing, it is by way of example and that the present invention is not intended to be defined thereby. It will be understood by those skilled in the art that various changes and modifications may be made without departing from the spirit and scope of the present invention, which is intended to be defined only by the appended claims.

What is claimed is:

1. A breakerless ignition system for an internal combustion engine comprising an ignition power supply, a capacitance connected to be charged from said ignition power supply, an ignition coil having a primary winding connected to said capacitance and a secondary winding connected to at least one spark plug, a first semiconductor switching means connected to discharge said capacitance through said primary winding of said ignition coil when said first semiconductor switching means is turned on, and an ignition signal source to trigger said first semiconductor switching means to be turned on, said ignition system further comprising an ignition inhibiting means including a second semiconductor switching means connected to prevent said ignition power from being applied to said capacitance; and a control circuit including flip-flop means operatively associated with said ignition signal source, a speed detector to produce an output signal when the speed of the internal combustion engine becomes less than a predetermined value, an intake vacuum pressure detector to produce an output signal when the intake vacuum pressure of the engine is greater than a predetermined value, and means to turn on said second semiconductor switching means when all of the outputs from said flip-flop means, said speed detector and said intake vacuum pressure detector are received.

2. A breakerless ignition system as set forth in claim 1, wherein said speed detector comprises a second capacitance, a DC power supply to charge said second capacitance, resistance means through which a charging current flows from said DC power supply to said second capacitance and a discharging current flows from said second capacitance, a Zener diode connected to be broken down by a voltage across said second capacitance, and a third semiconductor switching means to discharge said second capacitance when said third semiconductor switching means is conductive, and said third semiconductor switching means operatively associated with said flip-flop means so that said output signal from said flip-flop means turns on said third semiconductor switching means.

3. A breakerless ignition system as set forth in claim 1, wherein said intake vacuum pressure detector comprises a switching means and a diaphragm means operatively associated with said switching means so that it is opened or closed in response to movement of said diaphragm means.

4. A breakerless ignition system as set forth in claim 1, wherein said means to turn on said second semiconductor switching means comprises an AND gate connected to the outputs of said flip-flop means, said speed detector and said intake vacuum pressure detector to produce an output signal when all of said output signals from said flip-flop means, said speed detector and said intake vacuum pressure detector coincide, and said AND gate having the output connected to the control electrode of said second semiconductor switching means.

5. A breakerless ignition system as set forth in claim 4, wherein said AND gate comprises a first transistor connected to the control electrode of said second semiconductor switching means with the base connected to the output of said flip-flop means, a second transistor connected to the control electrode of said second semiconductor switching means and a third transistor connected to the base of said second transistor with the base of said third transistor connected to the output of said speed detector and to the output of said intake vacuum pressure detector, and a DC power supply connected to the control electrode of said second semiconductor switching means.

6. A breakerless ignition system as set forth in claim 2, wherein said AND gate comprises a first transistor connected to the control electrode of said second semiconductor switching means with the base connected to the output of said flip-flop means, a second transistor connected to the control electrode of said second semiconductor switching means and a third transistor connected to the base of said second transistor with the base of said third transistor connected to said second capacitance and to the output of said intake vacuum pressure detector, and said first transistor constituting said third semiconductor switching means to discharge said second capacitance of said speed detector while said DC power supply to charge said capacitance is also connected to the control electrode of said second semiconductor switching means.

7. A breakerless ignition system as set forth in claim 6, wherein said control circuit further comprises a Zener diode provided between said DC power supply and said AND gate, said Zener diode having the Zener voltage higher than the voltage at which said control circuit is erroneously operated due to drop of the terminal voltage of said DC power supply.

* * * * *